US005732976A

United States Patent [19]

Snyder

[11] Patent Number: 5,732,976

[45] Date of Patent: Mar. 31, 1998

[54] ACADEMIC MATERIAL ORGANIZING FOLDER

[76] Inventor: William C. Snyder, R.D. 1, Box 336, Ligonier, Pa. 15658

[21] Appl. No.: 610,207

[22] Filed: Mar. 4, 1996

[51] Int. Cl.[6] ..... B42D 3/00

[52] U.S. Cl. ..... 281/31; 281/29; 281/38; 281/37; 281/15.1

[58] Field of Search ..... 281/38, 29, 31, 281/15.1, 37; 190/901; D19/26, 27, 33; 40/359, 537, 654.01; 402/79

[56] References Cited

U.S. PATENT DOCUMENTS

| | | | |
|---|---|---|---|
| D. 132,746 | 6/1942 | Schenker | D19/26 |
| D. 322,987 | 1/1992 | Testro et al. | D19/26 |
| D. 359,310 | 6/1995 | Su | D19/26 |
| 2,755,837 | 7/1956 | Kosek | 190/901 |
| 4,802,575 | 2/1989 | Martin | 402/79 |
| 5,236,226 | 8/1993 | Sheffield | 281/31 |
| 5,360,234 | 11/1994 | Miller et al. | 281/37 |
| 5,509,746 | 4/1996 | Ho | 281/38 |

FOREIGN PATENT DOCUMENTS

| | | | |
|---|---|---|---|
| 29173 | 12/1904 | Switzerland | 40/537 |

*Primary Examiner*—A. L. Pitts
*Assistant Examiner*—Gregory Andoll

[57] ABSTRACT

An academic material organizing folder for maintaining academic papers in an organized orientation. The inventive device includes a front cover and a rear cover pivotally mounted together. A plurality of storage pocket pages are mounted between the covers and each include one or more pockets which can store academic assignments. A schedule listing is printed inside the front cover, and the rear cover includes a note pad, a note card storage slot, pre-printed labels for labeling the pockets, and a diskette pocket for storing computer disks to allow organization of all academic materials for a particular class.

4 Claims, 3 Drawing Sheets

ACADEMIC MATERIAL ORGANIZING FOLDER

BACKGROUND OF THE INVENTION

1. Field of the Invention

The present invention relates to folder structures and more particularly pertains to an academic material organizing folder for maintaining academic papers in an organized orientation.

2. Description of the Prior Art

The use of folder structures is known in the prior art. More specifically, folder structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art folder structures include U.S. Pat. No. 5,288,144; U.S. Pat. No. 5,215,398; U.S. Design Pat. No. 334,588; U.S. Pat. No. 5,160,296; U.S. Pat. No. 5,341,982; and U.S. Design Pat. No. 351,619.

While these devices fulfill their respective, particular objectives and requirements, the aforementioned patents do not disclose an academic material organizing folder which includes a front cover and a rear cover pivotally mounted together, a plurality of storage pocket pages mounted between the covers and each including at least one pocket for storing academic assignments, a schedule listing printed inside the front cover, with a note pad, a note card storage slot, pre-printed labels for labeling the pockets, and a diskette pocket mounted inside the back cover to permit organization of all academic materials for a particular class.

In these respects, the academic material organizing folder according to the present invention substantially departs from the conventional concepts and designs of the prior art, and in so doing provides an apparatus primarily developed for the purpose of maintaining academic papers in an organized orientation.

SUMMARY OF THE INVENTION

In view of the foregoing disadvantages inherent in the known types of folder structures now present in the prior art, the present invention provides a new academic material organizing folder construction wherein the same can be utilized for maintaining academic papers in an organized orientation. As such, the general purpose of the present invention, which will be described subsequently in greater detail, is to provide a new academic material organizing folder apparatus and method which has many of the advantages of the folder structures mentioned heretofore and many novel features that result in an academic material organizing folder which is not anticipated, rendered obvious, suggested, or even implied by any of the prior art folder structures, either alone or in any combination thereof.

To attain this, the present invention generally comprises an academic material organizing folder for maintaining academic papers in an organized orientation. The inventive device includes a front cover and a rear cover pivotally mounted together. A plurality of storage pocket pages are mounted between the covers and each include one or more pockets which can store academic assignments. A schedule listing is printed inside the front cover, and the rear cover includes a note pad, a note card storage slot, pre-printed labels for labeling the pockets, and a diskette pocket for storing computer disks to allow organization of all academic materials for a particular class.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new academic material organizing folder apparatus and method which has many of the advantages of the folder structures mentioned heretofore and many novel features that result in an academic material organizing folder which is not anticipated, rendered obvious, suggested, or even implied by any of the prior art folder structures, either alone or in any combination thereof.

It is another object of the present invention to provide a new academic material organizing folder which may be easily and efficiently manufactured and marketed.

It is a further object of the present invention to provide a new academic material organizing folder which is of a durable and reliable construction.

An even further object of the present invention is to provide a new academic material organizing folder which is susceptible of a low cost of manufacture with regard to both materials and labor, and which accordingly is then susceptible of low prices of sale to the consuming public, thereby making such academic material organizing folders economically available to the buying public.

Still yet another object of the present invention is to provide a new academic material organizing folder which provides in the apparatuses and methods of the prior art some of the advantages thereof, while simultaneously overcoming some of the disadvantages normally associated therewith.

Still another object of the present invention is to provide a new academic material organizing folder for maintaining academic papers in an organized orientation.

Yet another object of the present invention is to provide a new academic material organizing folder which includes a front cover and a rear cover pivotally mounted together, a plurality of storage pocket pages mounted between the covers and each including at least one pocket for storing academic assignments, a schedule listing printed inside the front cover, with a note pad, a note card storage slot, pre-printed labels for labeling the pockets, and a diskette pocket mounted inside the back cover to permit organization of all academic materials for a particular class.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
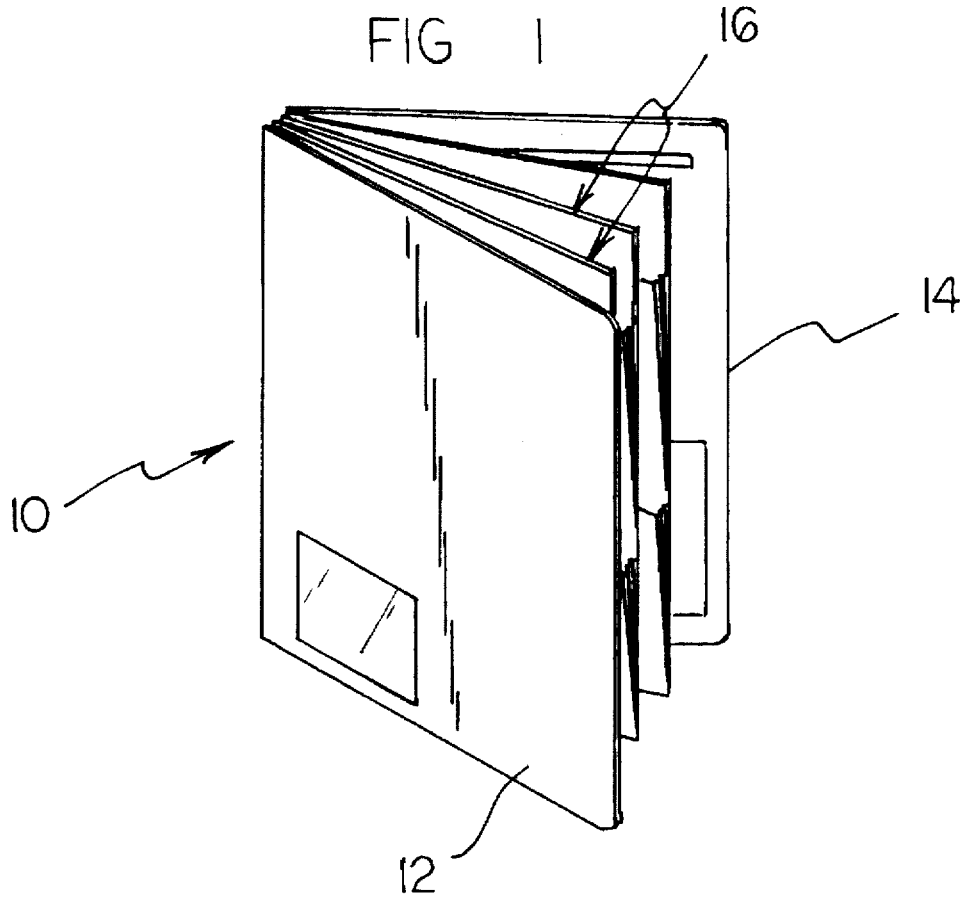
FIG. 1 is a perspective illustration of the preferred embodiment of the academic material organizing folder constructed in accordance with the principles of the present invention.

With reference now to the drawings, and in particular to FIGS. 1–6 thereof, a new academic material organizing folder embodying the principles and concepts of the present invention and generally designated by the reference numeral 10 will be described.

More specifically, it will be noted that the academic material organizing folder 10 comprises a front cover 12 pivotally coupled by a hinge or like binding to a rear cover 14. A plurality of storage pocket pages 16 are mounted between the covers 12 and 14 and each include at least one pocket within which academic materials such as essays, exams, or the like can be positioned. By this structure, academic materials for a course can be stored in a chronological or other desired order.

Figure 2:
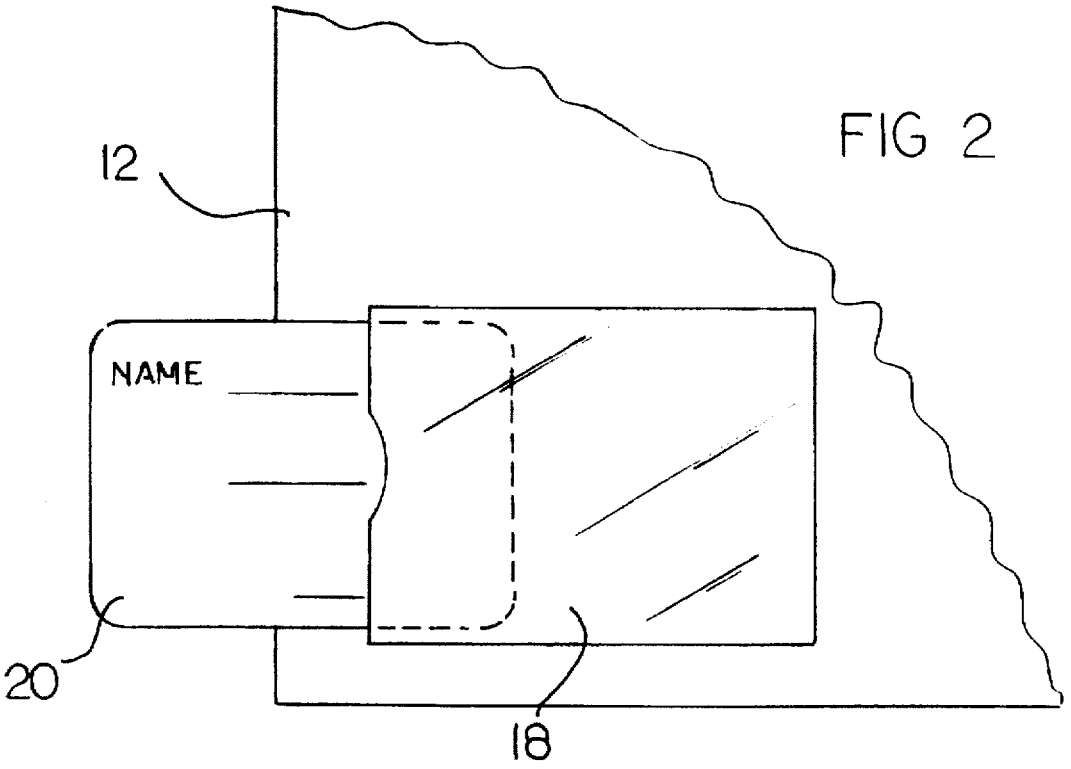
FIG. 2 is an enlarged front elevational view of a portion of the present invention.

As shown in FIG. 2, the front cover 12 includes a transparent sleeve 18 mounted thereto within which an identification tag 20 can be positioned. The identification tag 20 can be printed or filled out by the end user to display the name of the student, course, date, and other desired pertinent information to permit identification of the invention 10 to the owner and others.

Figure 3:
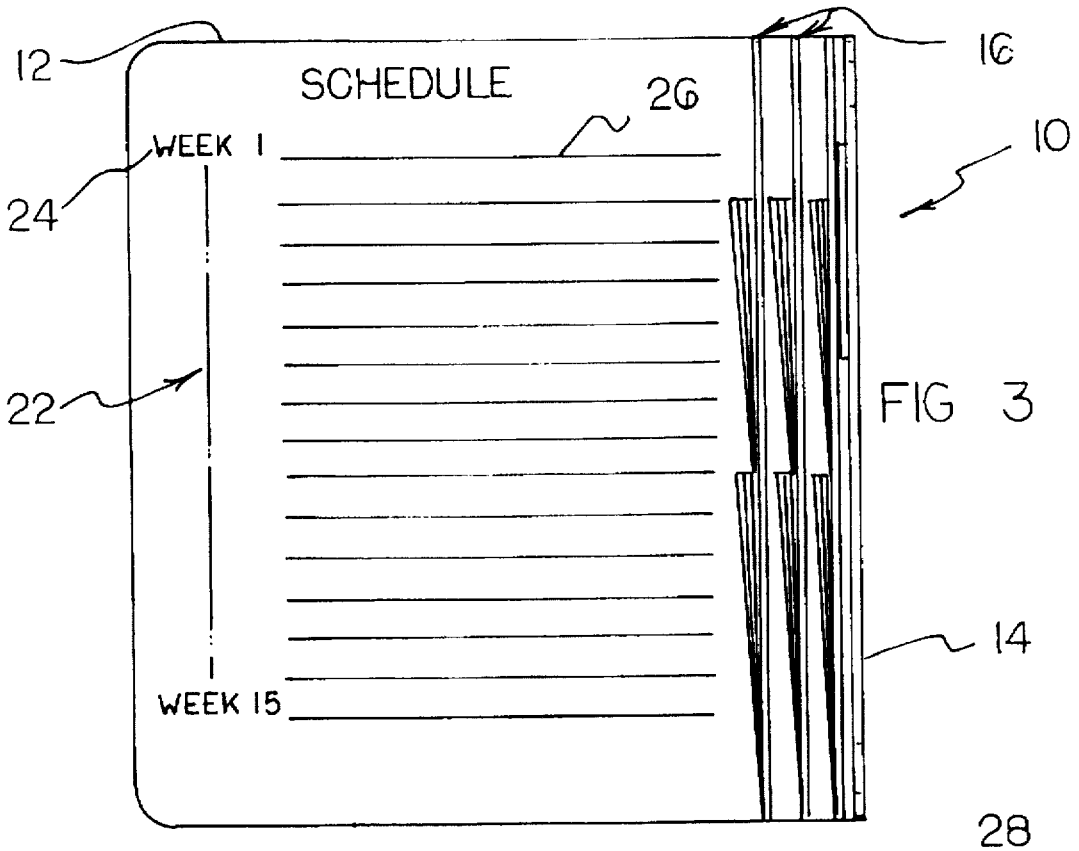
FIG. 3 is a side elevational view of the invention with the front cover open.

As shown in FIG. 3, the inside of the front cover 12 includes a schedule recording means 22 printed thereon which allows the user to record the progression of the course or other event, the materials for which are being stored within the invention 10. The schedule recording means 22 includes week identification indicia 24 which starts at week one increases by one week intervals to week 15, for example. The week identification indicia 24 are arranged in a first column one on top of the other, as shown in FIG. 3. A plurality of blank line indicia 26 is positioned in a column arranged parallel to and to the right of the week identification indicia 24. Each of the blank line indicia is arranged in a row with an individual one of the week identification indicia 24. By this structure, a user can write on the inside of the front cover along the blank line indicia a course or assignment for that week as indicated by the week identification indicia 24 positioned to the left of the line indicia. This allows for organization of the course within the user's mind, and allows for easy reference to the storage pocket pages for materials contained therein.

Figure 4:
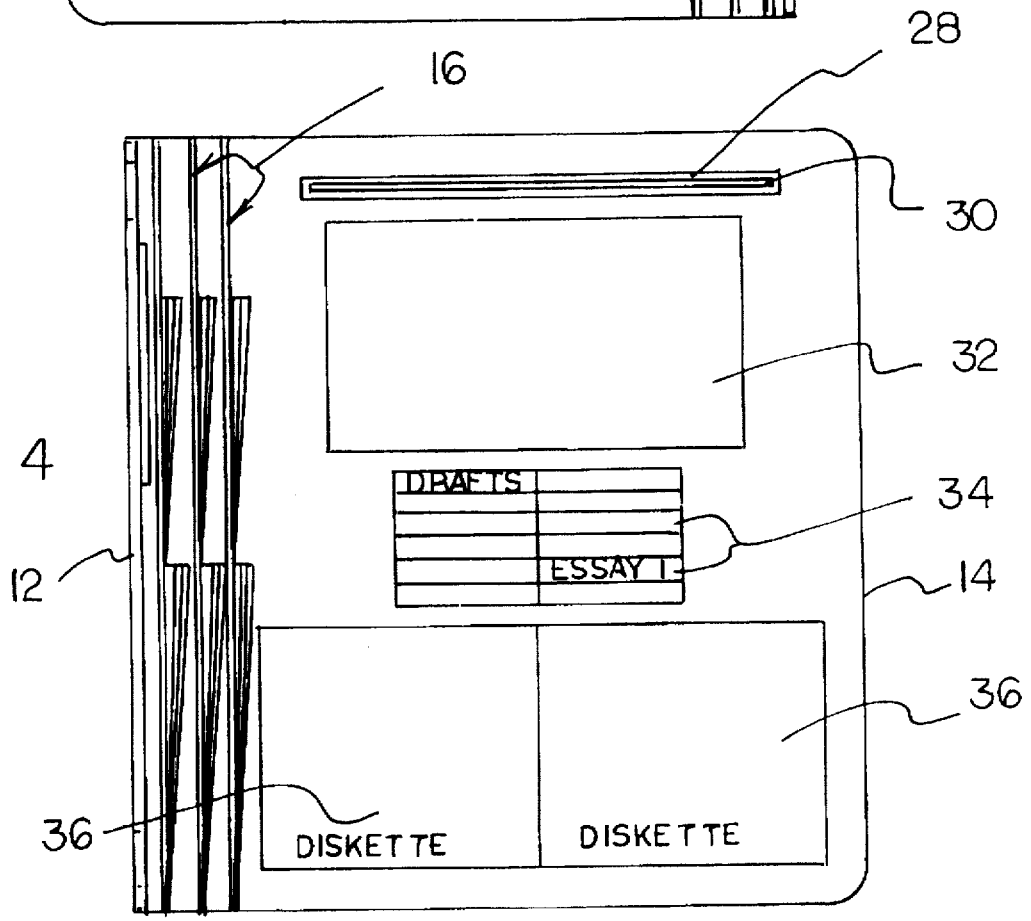
FIG. 4 is a side elevational view of the invention with the rear cover open.

FIG. 4 illustrates the inside of the rear cover 14 and it can be shown from this figure that a hollow note card storage slot 28 extends into rear cover 14 and operates to hold and contain a plurality of note cards 30. A note pad 32 is mounted to the inside of the rear cover 14 and includes separable pieces of paper which can be written on with a conventionally known and unillustrated pen. A plurality of pre-printed labels 34 are removably secured to the inside of the rear cover 14 and can be selectively separated therefrom for coupling to a desired on of the storage pocket pages 16 as will subsequently be described in more detail. To hold computer disks within the invention 10, one or more diskette pockets 36 is secured to the inside of the rear cover 14. Thus, the structure of the invention allows a variety of other academic materials, such as note cards, notes, and computer diskettes, to be stored or conveniently available with the academic materials of the course.

Figure 5:
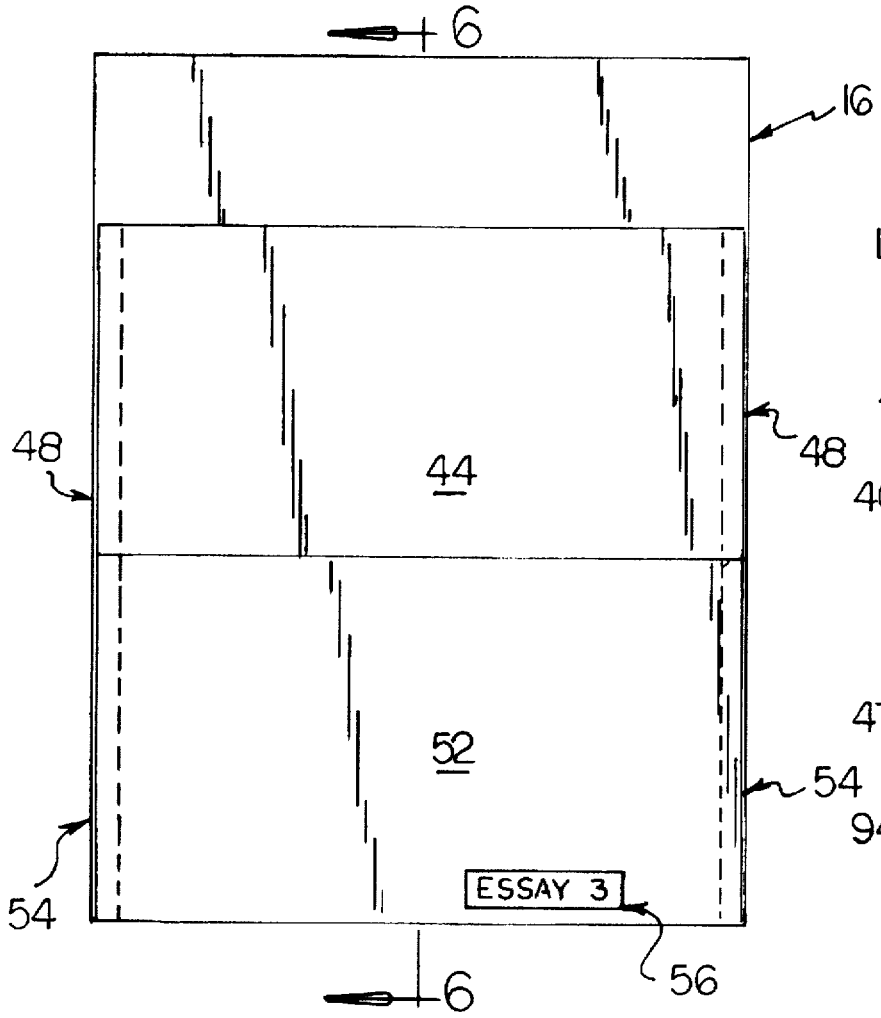
FIG. 5 is an elevational view of a single storage pocket page.
Figure 6:
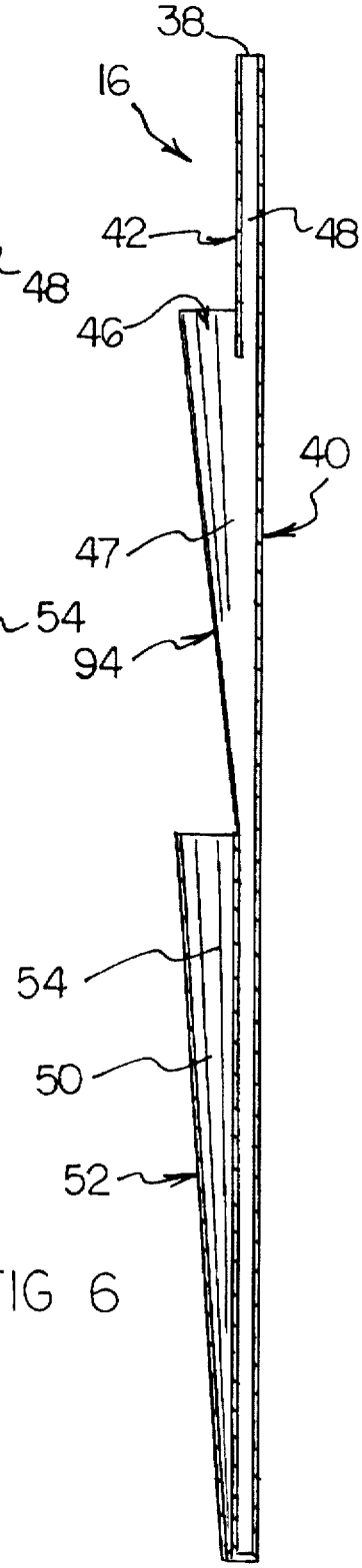
FIG. 6 is a cross sectional view taken along line 6—6 of FIG. 5.

Turning now to FIGS. 5 and 6, it can be shown that the storage pocket pages 16 each comprise a base page 38 which may be hollow and include an open upper end to allow placement of paper or like materials within the interior of the page 16. To this end, the base page 38 can comprise a rear panel 40 coupled at an outer peripheral edge thereof to an outer peripheral edge of a front panel 42 to define a hollow space in between the panels, as shown in FIG. 6. A medial portion of the front panel 42 is separated from an upper portion thereof to form a first pocket 44 having an opening 46 within which academic materials can be positioned. The opening 46 communicates with a hollow interior 47 of the pocket 44 which communicates with the hollow interior of the base page 38. Lateral edges of the medial portion of the front panel 42 are coupled to the outer peripheral edge of the base page 38 by accordion folded sides 48. By this structure, academic materials such as essays or papers can be positioned within the first pocket for storage.

A second pocket 50 can be provided with the storage pocket page 16 and includes a pocket panel 52 coupled at a bottom edge of the pocket panel 52 to the base page 38. A pair of second pocket accordion folded sides 54 couple lateral edges of the pocket panel 52 to the outer peripheral edge of the base page 38. By this structure, more academic material can be held and organized as desired within each of the storage pocket pages 16.

To identify each of the storage pocket pages 16 with a desired portion of an academic course or other activity, each of the storage pocket pages 16 includes a second transparent sleeve 56 secured thereto within which one of the pre-printed labels 34 can be positioned for identification of the materials within a particular one of the storage pocket pages. By this structure, reference can be easily had to a desired portion of the course by simply flipping to the appropriately labeled storage pocket page 16.

In use, the academic material organizing folder 10 of the present invention 10 can be easily utilized for maintaining academic papers in an organized orientation. The individual storage pocket pages can be labeled to represent either (1) stages or phases in the developmental process, or (2) subcategories of work done by the student for a particular course or topic. The consecutive pages 16 can be referred to as platforms one, two, and three. Thus, according to the teacher's direction, a student could place the most recent work in platform one, and previous work in platforms two and three, for example. Alternatively, the student could places quizzes or tests in platform one, essays in platform two, and prep work in platform 3. Further, the student could place past work and drafts in platforms two and three, and use platform one to contain current work. These are merely examples of particular uses for the invention 10, however, and should not be considered limiting as to the utility of the invention.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An academic material organizing folder comprising:

a front cover;

a rear cover pivotally coupled to the front cover;

a plurality of storage pocket pages mounted between the covers, each of the storage pocket pages including at least one pocket within which academic materials can be positioned, each of the storage pocket pages comprises a hollow base page, the base page comprising a rear panel and a front panel coupled at an outer peripheral edge thereof to an outer peripheral edge of the rear panel to define a hollow space in between the panels, with a medial portion of the front panel being separated from an upper portion thereof to form a first pocket having a hollow interior and an opening within which materials can be positioned, the opening being in communication with the hollow interior of the pocket, the hollow interior being in communication with the hollow space of the base page, and accordion folded sides coupling the lateral edges of the medial portion of the front panel to the outer peripheral edge of the base page.

2. The academic material organizing folder of claim 1, wherein each of the storage pocket pages further comprises a second pocket comprising a pocket panel coupled at a bottom edge of the pocket panel to the base page, and a pair of second pocket accordion folded sides coupling lateral edges of the pocket panel to the outer peripheral edge of the base page.

3. The academic material organizing folder of claim 2, wherein the base page of each of the storage pocket pages includes an open upper end to allow placement of materials within the hollow space of the base page.

4. The academic material organizing folder of claim 1, and further comprising a plurality of pre-printed labels removably secured to one of the covers, wherein an individual one of the pre-printed labels can be selectively separated from the cover and secured to an individual one of the storage pocket pages.

* * * * *